US010260179B2

(12) United States Patent
Rodrigues Pereira et al.

(10) Patent No.: US 10,260,179 B2
(45) Date of Patent: Apr. 16, 2019

(54) NET WITH IDENTIFICATION AND TRACEABILITY SYSTEM

(71) Applicant: CORDENET—PRODUTORA DE REDES AGRICOLAS S.A., Esmoriz (PT)

(72) Inventors: Manuel Alberto Rodrigues Pereira, Esmoriz (PT); Mario Mendes, Guardizela (PT); Joana Margarida De Oliveira Barbas, Sao Felix da Marinha (PT)

(73) Assignee: CORDENET—PRODUTORA DE REDES AGRICOLAS S.A., Esmoriz (PT)

( * ) Notice: Subject to any disclaimer, the term of this patent is extended or adjusted under 35 U.S.C. 154(b) by 127 days.

(21) Appl. No.: 15/514,137

(22) PCT Filed: Sep. 3, 2015

(86) PCT No.: PCT/IB2015/056708
§ 371 (c)(1),
(2) Date: Mar. 24, 2017

(87) PCT Pub. No.: WO2016/051293
PCT Pub. Date: Apr. 7, 2016

(65) Prior Publication Data

US 2017/0283998 A1 Oct. 5, 2017

(30) Foreign Application Priority Data

Sep. 30, 2014 (PT) ..... 107933

(51) Int. Cl.
*D04B 21/12* (2006.01)
*D04B 1/12* (2006.01)

(52) U.S. Cl.
CPC ..... *D04B 21/12* (2013.01); *D04B 1/126* (2013.01); *D10B 2403/0311* (2013.01); *D10B 2505/10* (2013.01)

(58) Field of Classification Search
CPC ..... D04B 21/12; D04B 1/126
See application file for complete search history.

(56) References Cited

U.S. PATENT DOCUMENTS 2,272,229 A * 2/1942 Tucker ..... D06H 1/00 139/383 R
4,196,534 A * 4/1980 Shibamoto ..... B65D 29/04 383/117

(Continued)

FOREIGN PATENT DOCUMENTS

EP 1743968 A1 1/2001

OTHER PUBLICATIONS

International Search Report for International Application No. PCT/IB2015/056708 (dated Dec. 8, 2015) (4 Pages).

*Primary Examiner* — Danny Worrell
(74) *Attorney, Agent, or Firm* — Lucas & Mercanti, LLP

(57) ABSTRACT

The present application describes a net with identification and traceability system, in particular a knitted net of the Raschel type, for packing products by wrapping, that contains a position-color scheme distributed across the width of the knitted net and applied during weaving on looms which transposition for numerical code enables the processing of information by electronic reading devices suitable for production management and control. The solution disclosed in the present application aims at complementing identification systems currently applied in these products, in which the identifying code is applied in the cardboard tube wherein the (Continued)

agricultural net is winded, which is destroyed/recycled after application of the net in the field, making it impossible to trace the product.

15 Claims, 3 Drawing Sheets

(56) References Cited

U.S. PATENT DOCUMENTS

| | | | | |
|---|---|---|---|---|
| 4,958,388 | A * | 9/1990 | Madden, III | A41B 11/001 2/239 |
| 6,001,458 | A | 12/1999 | Heir et al. | |
| 6,698,251 | B1 * | 3/2004 | Smyre, IV | D04B 21/06 66/193 |
| 2014/0179184 | A1 | 6/2014 | Lieber et al. | |

* cited by examiner

NET WITH IDENTIFICATION AND TRACEABILITY SYSTEM

CROSS REFERENCE TO RELATED APPLICATION

This Application is a 371 of PCT/IB2015/056708 filed on Sep. 3, 2015, which claims the benefit of Portuguese Application No. 107933 filed on Sep. 30, 2014, the contents of each of which are incorporated herein by reference.

TECHNICAL DOMAIN

The present application describes a net with identification and traceability system.

BACKGROUND

It is of the state of the art knowledge, the existence of identifying codes applied in the tube where the agricultural net is winded. This type of solution leads to undesirable situations. The products wrapped by these agricultural nets tend to be stored for long periods of time in which the consumer does not store the rolls where the net was initially winded.

Thus, the present technical solution aims to overcome the problem of rapid identification and traceability of agricultural net used in a particular storage.

SUMMARY

The present application describes a knitted net comprising an identification and traceability system, composed by a color scheme distributed across the width of the net and comprising a plurality of longitudinal knitted chains (warps) and a plurality of transverse yarns (weft) and by the angle formed between the warp and the weft being comprised between 35°-50°.

In one embodiment, the net's weft cross the warp every 2, 4, 6 or 8 stitches of the warp and/or successive weft cross the warp in the same stitch of the knitted chain.

In another embodiment, the number of net's warp ranges between 25 and 75 and the number of weft (4) ranges between 24 and 74.

In yet another embodiment, the net identification and traceability system enables the left-right orientation for net positioning, as well as year, month, week and loom of production.

In one embodiment, the net's warps/wefts are composed of a plurality of colors.

In another embodiment, the fraction of color elements of the net is comprehended between 30%-50% of all warps/wefts.

In yet another embodiment, the fraction of color elements of the net is constituted by 35% to 45% of all elements.

In one embodiment, the fraction of net's color elements is constituted by 39% to 41% of all elements.

In another embodiment, the identifying color block of the net's left-right direction is constituted by 25%-35% of the total warps/wefts present and the block for the indication of left-right direction is constituted by 9 to 21 consecutive warps/wefts on the left side of the net.

In yet another embodiment, the indicative segment of the net's year has 3 available positions of warp/weft in a position shifted to the right relative to the last assigned identifying element.

In one embodiment, the indicative segment of the net's production month has 12 available positions of warp/weft, in a position shifted to the right relative to the last identification element assigned to the year.

In another embodiment, the indicative segment of the net's production week has 4 positions of warp/weft in a position shifted to the right relative to the last identification element assigned to the month.

In yet another embodiment, the net's segment relative to the loom has 15 positions of warp/weft available in a position shifted to the right relative to the last identification element assigned to the week.

In one embodiment, the net is elaborated in polymeric material, namely polyolefin either in the warps or in the wefts.

In another embodiment, the code used in the identification of the net is still placed on bar codes, QR codes, or other alphanumeric systems, applied in self-adhesive labels applied on the net's winding tube.

In yet another embodiment, the reading of the net's code is made from any electronic reading device.

In one embodiment, the information contained in the net's code is incorporated in the warps or wefts, through the recording process.

GENERAL DESCRIPTION

The present application discloses a net with identification and traceability system, in particular a knitted net of the Raschel type, for packing products by wrapping, which contains a position-color scheme distributed by the width of the knitted net. This scheme can be applied during the weaving in loom and its transposition into numeric code allows processing the information by appropriate software for production management and control.

The technical solution presented by the present application aims at complementing identification systems currently applied in these products, in which the identifying code is applied in the tube wherein the agricultural net is winded, which is destroyed/recycled after application of the net in the field, making it impossible the correct and rapid traceability of the product.

BRIEF DESCRIPTION OF THE FIGURES

For an easier understanding of the technology, examples of embodiments of the technology are described below, which, however, are not intended to limit the subject of the present application.

1—net;
2—warp;
3—warp knitted stitch;
4—weft.

Figure 2:
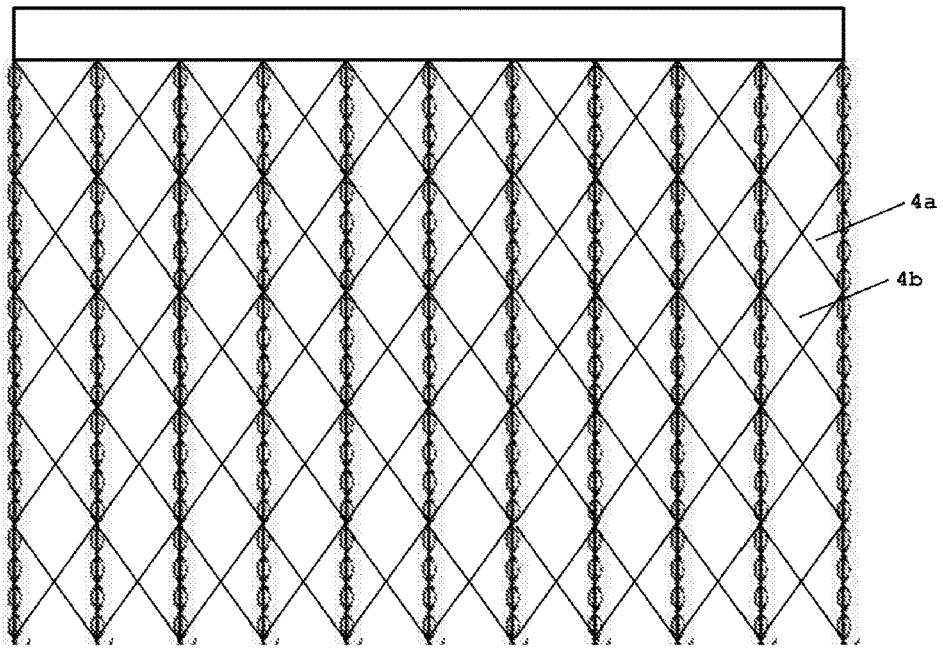

FIG. 2 illustrates a schematic representation of the reinforced net of an embodiment with two wefts, wherein the reference numbers represent:

4*a*—double weft;
4*b*—second weft in opposition.

Figure 3:
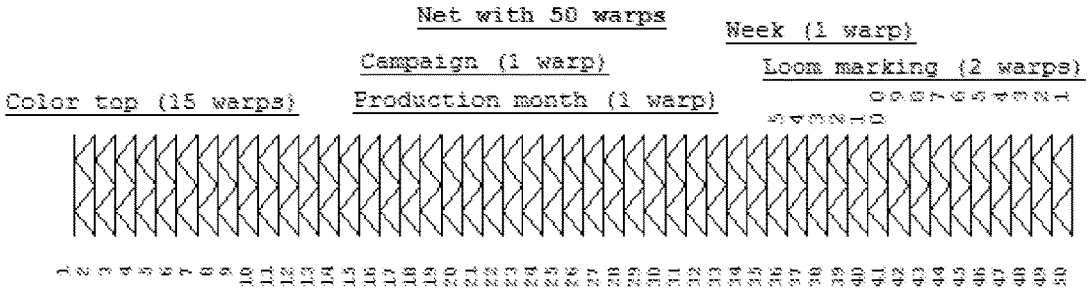

FIG. 3 illustrates a schematic representation of the coding system applied to the warps of a net with 1230 mm, using the 50 warps that constitute it.

Figure 4:
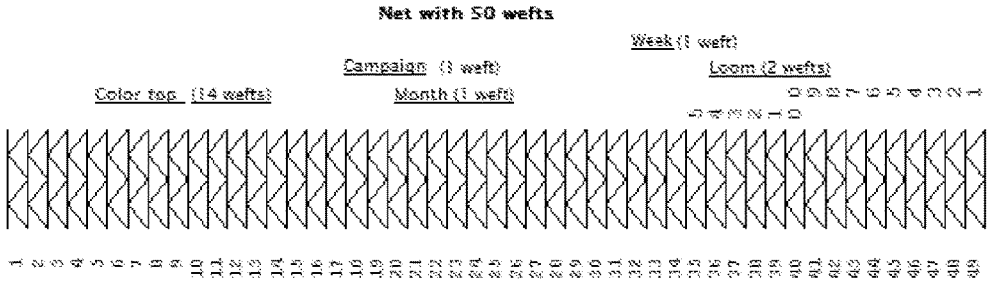

FIG. 4 illustrates a schematic representation of the coding system applied to the wefts of a net with 1230 mm, using the 49 wefts that constitute it.

Figure 5:
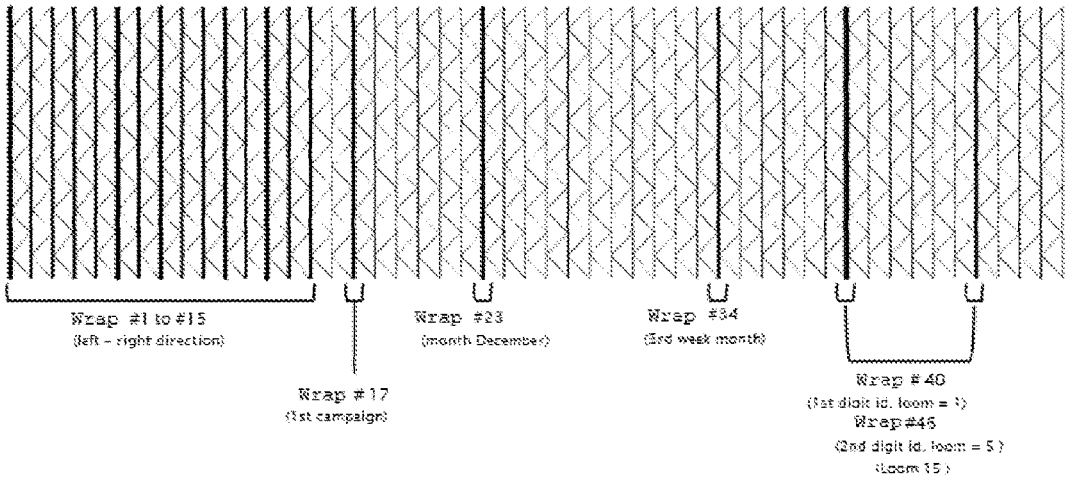

FIG. 5 illustrates a representation of the warp position-color scheme taking into account the transposition of the numerical code batch of a net as contained in Example 1.

Figure 6:
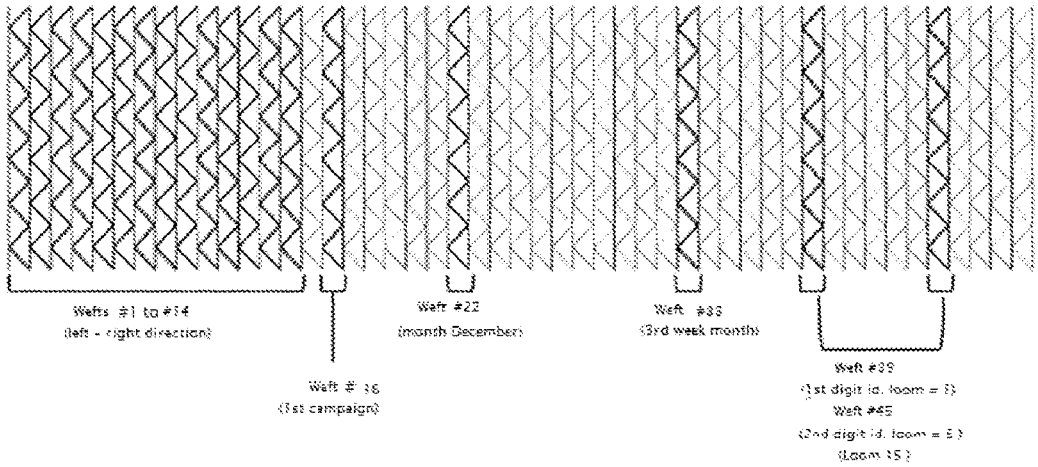

FIG. 6 illustrates a representation of the weft position-color scheme taking into account the transposition of the numerical code batch of a net as contained in Example 2.

DESCRIPTION OF THE EMBODIMENTS

Next, some elements of the invention are presented in greater detail resorting to figures and embodiments that however are not intended to limit the scope of the present application.

One of the embodiments of the technology disclosed in the present application applies particularly to a knitted (1) net of the Raschel type for packing products by wrapping, comprising a plurality of longitudinal warps (2) with knitted stitches (3) and a plurality of transverse weft tapes (4), wherein the angle formed between the warps and the weft is between 35°-50°, in particular:

- the weft cross the warp every 2, 4, 6 or 8 knitted stitches of the knitted chain for standard Raschel nets, and/or
- the weft successive cross the warp in the same knitted stitch of the warp.

The identification and traceability system described will be dependent on the total net width, which depends in turn on the number of warps (2), which can range between 25 and 75, and the number of wefts (4), which can range between 24 and 74, depending on the number of applied warps, enabling visual representation of the left-right orientation for net positioning, as well as year, month, week and loom, where the production was carried out.

The warp or weft that translate the identification information and traceability to the production batch should have distinctive color from the remaining that constitutes the knitted net. On the other hand, the color of the warp or weft should allow the visualization of the constant pattern of the net when it is applied.

The so-described net will consist of warps/wefts in a plurality of colors, so that the distribution of the warps/wefts that translate the identification and traceability information to the production batch, reproduce a visual effect in the net similar to a barcode.

Preferably, the net will consist of warps/wefts with 2 colors, and may have white as a base/neutral color and having as the colors of the identification and traceability information the primary colors or any resulting color of combinations thereof, preferably purple or violet.

In a knitted net, with 30 to 70 warps and 29 to 69 wefts, respectively, the fraction of color elements (warp/weft) should comprise between 30%-50% of all warps/wefts, in particular the fraction of color elements that translate the identification and traceability system that constitutes 35%-45% of all the elements, preferably 39%-41%, thus existing 12 to 29 warps as distinct color elements to comply with the position-color scheme described in the present application.

On the other hand, the identifying color block of the left-right direction of net's orientation constitutes between 25% to 35% of the total warps/wefts present, preferably between 29% to 31% of all elements and the block for the indication of left-right direction is constituted by 9 to 21 consecutive warps/wefts, in one of the ends of the net, particularly on the left side of the knitted net.

Likewise, the indicative segment of the year of production has at least three warp/weft positions available for years 1, 2 and 3, after which the counting restarts at a position shifted to the right relative to the last identification element assigned to the indication block of the left-right direction. In particular, the marking of the year of production appears in the elements 10 to 30 depending on the total number of elements that constitute the net total width.

The indicative segment of the production month has 12 warp/weft positions available, successively marking the months since the month September of one year to August of the following year, at a position shifted to the right relative to the last identification element assigned to the year. In a more particular form, the marking of the month of production appears in the elements 13 to 45 depending on the total number of elements that constitute the net total width.

For its part, the indicative segment of the production week has 4 positions of warp/weft available, week 1, 2, 3 and 4, in a position shifted to the right relative to the last identification element assigned to the month. In particular, the marking of the production week appears in elements 25 to 50 depending on the total number of elements that constitute the net total width.

The indicative segment of the loom used in the production has 15 positions of available warp/weft, in a position shifted to the right relative to the last identification element assigned to the week. In a more particular form, the marking of the production loom appears in the elements to 70 depending on the total number of elements that constitute the net total width. In an even more particular manner, considering a production area with up to 59 available looms, the first five marking elements indicate the tens, from 5 to 1, respectively; the sixth element corresponds to zero; the following nine elements indicate the units, from 9 to 1 respectively.

It should be noted that the disclosed net in the present application comprises a plurality of longitudinal warp chains (2) with knitted stitches and a plurality of transverse weft tapes (3), wherein the angle formed between the warp (2) and the weft (3) can range between 35-50°, preferably between 43°-47°, and most preferably 45°, when the net packs a product by wrapping.

In a particular embodiment the weft (3) cross the warp tapes (2) every 2, 4, 6 or 8 knitted stitches (4) of the warp chain (2) for standard Raschel nets.

In another embodiment of the described knitted net, the weft (3) crosses the warp (2) every 2, 4, 6 or 8 knitted stitches (4) of the warp, so as to create a triangle/diamond-shape structure along the net (1).

In one embodiment, the described net may be elaborated in polymeric material, namely in polyolefin, either in the warps or in the wefts.

In an even more preferred embodiment of the knitted net described in the present application, the number of stitches per cm can range between 0.5 and 2.1 stitches per cm. That is, the length of the stitches can range between 0.476 and 2 cm, in particular 1.20 cm; 1.21 cm; 1.22 cm; 1.23 cm; 1.24 cm; 1.25 cm; 1.26 cm; 1.27 cm; 1.28 cm; 1.29 cm; 1.30 cm. In a further particular case, the spacing between warps is between 2.50 cm and 2.55 cm, namely 2.50 cm; 2.51 cm; 2.52 cm; 2.53 cm; 2.54 cm and 2.55 cm.

In another embodiment of the knitted net described in the present application the weft length (3) of the knitted net may be greater than 106%, preferably greater than 110%, than the weft length obtained in conventional nets—i.e. the effective transverse length of the weft (3) of the knitted net may be greater than 106% or greater than 110%, than the required length of the weft (3).

The knitted net of the present application shows minimum breaking strength of 270 kg, the typical linear density values being between 10 and 10.5 g/m. The typical elongation values are between 15%-20%.

The knitted nets now disclosed are used for packaging agricultural products by wrapping namely cylindrical/round bales, preferably bundles of straw, fodder, material for silage, severed corn, pressed pulp, shredded plastic waste or fragmented household waste.

By warp (2) it is meant the chain that, during the manufacturing process of the net (1), runs lengthwise in the direction of the production, the warp (2) being formed by knitted stitches (3).

By weft (4) it is meant the tape that, during the manufacturing process of the net (1), runs in the transverse direction.

Each stitch (3) corresponds to a knitted loop. The loops are not formed gradually, but all at the same time forming a warp stitch in every needle.

The knitted nets are produced using polymeric materials such as polyolefins, either in the warps or in the wefts.

Figure 1:
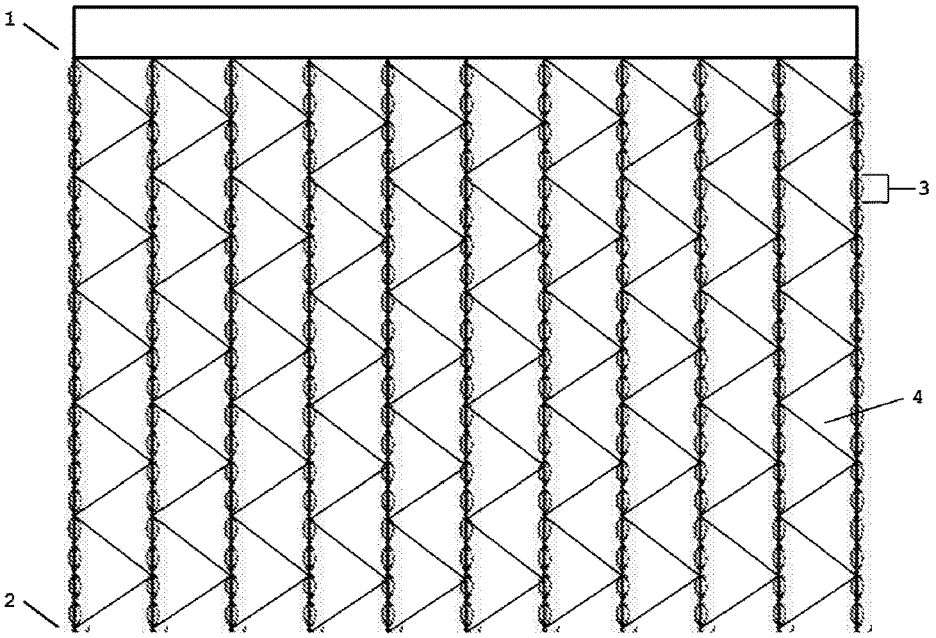
FIG. 1 illustrates a schematic representation of the knitted net in which the triangle base is composed of four knits, in which the reference numbers represent.

As it can be seen in FIG. 1, the net (1), knitted with warps (2) and wefts (4), namely a simple weft (4), comprises a triangle shaped geometry, in a preferred embodiment with 4 stitches.

In FIG. 2, it is represented a preferred embodiment of the net reinforced with two wefts—with double weft (4*a*) and an opposed second weft (4*b*), knitted with warps and wefts, namely a double weft, originating a diamond geometry constituted by 8 stitches. That is, the weft (4) crosses the warp (2) every 8 knitted stitches of the warp, so as to create a diamond-shape structure along the net (1).

The knitted net is collected in the loom directly to a cardboard/plastic tube.

In order to enable identification of the product, the identification and traceability system applied to the net object of this application presents a position-color scheme, applied to the warps/wefts, that transposes directly to the net's visual aspect the internal alphanumeric code used to identify the product, which may be also placed in bar codes, QR codes, or other alphanumeric systems applied in self-adhesive labels, in its turn applied in the collection tube of the knitted net, complementing the visual information and allowing, in this case, the reading of such codes, from any electronic reading device.

Likewise, the information contained in said code can be incorporated into warps or wefts, through the recording process in polymers, so that its reading can be made, besides the visual reading, by electronic devices in the absence of the tube or packaging, enabling a more precise answer by the producer to eventual problems/complaints of net usage by the consumer.

APPLICATION EXAMPLES

Example 1

As an example of an embodiment of the technology disclosed in the present application, a knitted net with 1230 mm wide is presented, preferably constituted by 50 warps and 49 wefts, wherein the encoding system applied in the warps uses: the warps 1 to 15 to indicate the left-right direction of net's orientation; uses the warps 17 to 19 for marking the year of production, wherein the year 1 marks warp 17, year 2 marks warp 18 and year 3 marks warp 19, and after 3 campaigns the encoding restarts; the warps 20 to 31 to indicate the month of production, warp 20 referring the month of September and warp 31 referring the month of August of the following year; the warps 32 to 35 mark the production week since the 1st week of the month until the 4th, respectively; the warps 36 to 50 produce marks of the loom used in the production according to internal identification assigned to machines, particularly given an area having 1 to 59 looms sequentially numbered, the warps 36 to 40 mark the tens digit, from 5 to 1 respectively, the warp 41 marks the zero, and the warps 42 to 50 mark the units digits, from 9 to 1 respectively. The so defined distribution is shown in Table 1.

In a more specific form, to a knitted net with 1230 mm wide produced during the 1st campaign, for example 2014-2015, in the 3rd week of December, in the loom identified as 15, corresponds the numeric code of batch identification 1723344046, translated in accordance with the provisions laid in Table 1. Assuming the position-color scheme applied in the warps, the net thus described will have a visual aspect that transposes the above numerical code and is represented in FIG. 5.

TABLE 1

Correspondence between the numeric code and the position-color scheme described in the present invention with regard to a net with a total of 50 warps.
Position-color correspondence

| Campaign | | Month | | Week | | Loom | | |
|---|---|---|---|---|---|---|---|---|
| Warp | # | Warp | | Warp | | Warp | # (1) | # (2) |
| 17 | 1st | 20 | September | 32 | 1 | 36 | 5 | |
| 18 | 2nd | 21 | October | 33 | 2 | 37 | 4 | |
| 19 | 3rd | 22 | November | 34 | 3 | 38 | 3 | |
| | | 23 | December | 35 | 4 | 39 | 2 | |
| | | 24 | January | | | 40 | 1 | |
| | | 25 | February | | | 41 | 0 | 0 |
| | | 26 | March | | | 42 | | 9 |
| | | 27 | April | | | 43 | | 8 |
| | | 28 | May | | | 44 | | 7 |
| | | 29 | June | | | 45 | | 6 |
| | | 30 | July | | | 46 | | 5 |
| | | 31 | August | | | 47 | | 4 |
| | | | | | | 48 | | 3 |
| | | | | | | 49 | | 2 |
| | | | | | | 50 | | 1 |

Example 2

As an example of one embodiment of the technology disclosed in the present application, a knitted net with 1230 mm wide is presented, preferably constituted by 50 warps and 49 wefts, wherein the encoding system applied in the weft uses: the wefts 1 to 14 to indicate the left-right direction of net's orientation; uses the wefts 16 to 18 for marking the year of production, wherein year 1 marks weft 16, year 2 marks weft 17 and year 3 marks weft 18, and after 3 campaigns the encoding is restarted; the wefts 19 to 30 to indicate the month of production, being the weft 19 for the month of September and the weft 30 for the month of August of the following year; the weft 31 to 34 mark the production week from the 1st week of the month until the 4th, respectively; the wefts 35 to 49 produce marks of the loom used in the production according to internal identification assigned to the machines, particularly given an area having 1 to 59 looms sequentially numbered, the wefts 35 to 39 marks the tens digit, from 5 to 1 respectively, the weft 40 marks the zero, and the weft 41 to 49 marks the units digits, from 9 to 1 respectively. The so defined distribution is shown in Table 2.

More particularly, to a knitted net with 1230 mm wide, produced during the 1st campaign, for example 2014-2015, in the 3rd week of December, in the loom identified as 15 taking into account the internal loom serial identification, corresponds the numeric code of batch identification 1622333945, translated in accordance with the provisions laid in Table 2. Assuming the position-color scheme applied in the wefts, the net thus described will have a visual aspect that transposes the above numerical code and is represented in FIG. 6.

TABLE 2

Correspondence between the numeric code and the position-color scheme described in the present invention with regard to a net with a total of 49 wefts.
Position-color correspondence

| Campaign | | Month | | Week | | Loom | | |
|---|---|---|---|---|---|---|---|---|
| Weft | # | Weft | # | Weft | | Weft | # (1) | # (2) |
| 16 | 1st | 19 | September | 31 | 1 | 35 | 5 | |
| 17 | 2nd | 20 | October | 32 | 2 | 36 | 4 | |
| 18 | 3rd | 21 | November | 33 | 3 | 37 | 3 | |
| | | 22 | December | 34 | 4 | 38 | 2 | |
| | | 23 | January | | | 39 | 1 | |
| | | 24 | February | | | 40 | 0 | 0 |
| | | 25 | March | | | 41 | | 9 |
| | | 26 | April | | | 42 | | 8 |
| | | 27 | May | | | 43 | | 7 |
| | | 28 | June | | | 44 | | 6 |
| | | 29 | July | | | 45 | | 5 |
| | | 30 | August | | | 46 | | 4 |
| | | | | | | 47 | | 3 |
| | | | | | | 48 | | 2 |
| | | | | | | 49 | | 1 |

The present embodiment is naturally not in any way restricted to the embodiments described herein and a person of ordinary skills in the art can provide many modification possibilities thereof without departing from the general idea, as defined in the claims.

The preferred embodiments described above are of course combinable with one another. The following claims further define preferred embodiments.

The invention claimed is:

1. A knitted net having an identification and traceability system, the knitted net comprising:

a plurality of longitudinal warp chains with knitted stitches; and a plurality of transverse weft tapes;

wherein a selected one of the plurality of longitudinal warp chains and the plurality of transverse weft tapes comprises a color pattern identifying a left-right orientation for net positioning, a year, a month, a week and a loom of production wherein an angle formed between the plurality of longitudinal warp chains and the plurality of transverse weft tapes is between 35°-50° when no tension is applied to the knitted net.

2. The net according to claim 1 wherein each of the transverse weft tapes crosses one of the plurality of longitudinal warp chains every 2, 4, 6 or 8 knitted stitches of the plurality of longitudinal warp chains, or successive transverse weft tapes cross the longitudinal warp chains in a selected knitted stitch of the longitudinal warp chains.

3. The net according to claim 1 further comprising between 25 and 75 longitudinal warp chains and between 24 and 74 transverse weft tapes.

4. The net according to claim 1, wherein the plurality of longitudinal warp chains and the plurality of transverse weft tapes comprise a plurality of colors.

5. The net according to claim 4 wherein the color pattern includes a first fraction of elements having a base color and a second fraction of elements having a second color used to identify the left-right orientation for net positioning, the year, month, week, and loom of production, the elements being the selected one of the plurality of longitudinal warp chains and the plurality of transverse weft tapes, wherein the second fraction is between 30%-50%.

6. The net according to claim 5 wherein the second fraction is between 35% to 45%.

7. The net according to claim 5, wherein the second fraction is between 39% to 41%.

8. The net according to claim 7 wherein a portion of the selected one of the plurality of longitudinal warp chains and the plurality of transverse weft tapes are used to identify the left-right orientation for net positioning, the portion comprising between 9 and 21 longitudinal warp chains or transverse weft tapes, the portion representing a third fraction of the selected one of the plurality of longitudinal warp chains and the plurality of transverse weft tapes, the third fraction being between 25%-35%.

9. The net according to claim 1 wherein a portion of the selected one of the plurality of longitudinal warp chains and the plurality of transverse weft tapes are used to identify the year, wherein the portion has 3 available positions in a position shifted relative to a previously assigned identification element.

10. The net according to claim 1 wherein a portion of the selected one of the plurality of longitudinal warp chains and the plurality of transverse weft tapes are used to identify the month has 12 available positions in a position shifted to assigned element.

11. The net according to claim 1 wherein a portion of the selected one of the plurality of longitudinal warp chains and the plurality of transverse weft tapes are used to identify the week has 4 available positions in a position shifted relative to a previously assigned element.

12. The net according to claim 1 wherein a portion of the selected one of the plurality of longitudinal warp chains and the plurality of transverse weft tapes are used to identify the loom has 15 available positions of in a position shifted relative to a previously assigned element.

13. The net according to claim 1 comprising a polymeric material.

14. The net according to claim 1 wherein the color pattern comprises a code used in one of bar codes and QR codes.

15. The net according to claim 14 wherein the code is adapted to be read by an electronic reading device.

* * * * *